US006273745B1

(12) United States Patent
Yeh

(10) Patent No.: US 6,273,745 B1
(45) Date of Patent: Aug. 14, 2001

(54) CABLE CONNECTOR

(75) Inventor: Jeff Yeh, Taipei Hsien (TW)

(73) Assignee: Wing-Span Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/543,258

(22) Filed: Apr. 5, 2000

(51) Int. Cl.[7] ..... H01R 4/24
(52) U.S. Cl. ..... 439/404; 439/417
(58) Field of Search ..... 439/404, 417, 439/620, 405, 422

(56) References Cited

U.S. PATENT DOCUMENTS 4,538,873 * 9/1985 Worth ..... 439/404
5,536,182 * 7/1996 Atoh et al. ..... 439/404
5,766,033 * 6/1998 Davis ..... 439/405

* cited by examiner

*Primary Examiner*—Renee Luebke
*Assistant Examiner*—Briggitte Hammond
(74) *Attorney, Agent, or Firm*—Pro-Techtor International Services

(57) ABSTRACT

A cable connector comprises a terminal assembly, an upper terminal cover, a lower terminal cover, a plurality of insulation displacement terminals each having an attachment member for piercing through cable, and a conductive member wherein the conductive member includes a plurality of unit bodies each having a hole matingly engaged with a corresponding attachment member of terminal. Further, a connection point is connected between two adjacent unit bodies. As such, conductive member may be divided into a plurality of units by breaking connection points. In assembly, break conductive members into units for securing on terminal covers. Secure cable on terminal covers. Engagement mechanism secures upper terminal cover, terminal assemblies, and lower terminal cover together. Attachment members of terminals pierce through cable to engage with holes of conductive member. This can provide a good electrical contact and enhance the structural strength of connector.

8 Claims, 3 Drawing Sheets

CABLE CONNECTOR

FIELD OF THE INVENTION

The present invention relates to cable connector and more particularly to a cable connector with insulation displacement terminals.

BACKGROUND OF THE INVENTION

Conventionally, cable connectors are employed to provide an electrical connection between two electrical devices. With this, one device may transmit signals to and receive signals from the other device. For example, cable connector serves as a signal transmission medium between computer and connected printer. That is, parallel interface connector of printer is connected to cable connector. As such, the construction of cable connector should be strong enough to withstand the plugging, pulling, falling, and impact. As a result, a good signal transmission quality may be maintained as well as prolong the useful life of connector.

It is known that a conventional connector is configured to comprise a plurality of terminals. Also, not all terminals are employed to transmit signals to the other electrical device. That is, some terminals are reserved. Further, the spacing between two adjacent terminals are required to reduce in order to accommodate increased number of terminals in a defined area. For this reason, effort to provide a high quality signal transmission while accommodating more terminals particularly in insulation displacement type connector is still necessary.

It is also known that bolt and nut combinations and/or clips are used to secure terminal assembly, upper terminal cover, and lower terminal cover of a conventional connector together. However, such bolt and nut combinations are time consuming in installing. Further, connector is susceptible to damage. As to clips, they tend to loosen as time passes, resulting in a limitation of applicability.

SUMMARY OF THE INVENTION

It is thus an object of the present invention to provide a cable connector with insulation displacement terminals wherein the spacing between two adjacent terminals are reduced in compared to conventional connector.

It is another object of the present invention to provide a cable connector which is convenient to access and stable after assembled. With this, a good signal transmission quality may be maintained as well as prolong the useful life of connector.

In one aspect of the present invention, there is provided a cable connector comprising a terminal assembly, an upper terminal cover, a lower terminal cover, a plurality of insulation displacement terminals each having an attachment member for piercing through cable, and a conductive member wherein the conductive member includes a plurality of unit bodies each having a hole matingly engaged with a corresponding attachment member of terminal. Further, a connection point is connected between two adjacent unit bodies. As such, conductive member may be divided into a plurality of units by breaking connection points.

In another aspect of the present invention, there is provided a cable connector comprising an engagement mechanism for achieving the purpose of securing the components of cable connector in a simple way. The engagement mechanism comprises positioning pegs and corresponding positioning openings both disposed in terminal assembly and terminal covers wherein positioning peg of terminal assembly is extended in both upward and downward directions to engage with positioning openings of terminal covers, positioning pegs of upper terminal cover have wedge shapes and positioning pegs of lower terminal cover have mating wedge shapes, and both positioning pegs of upper terminal cover and lower terminal cover are engaged with positioning openings of terminal assembly. With this, the convenience of assembly is increased and the structural strength of connector is enhanced.

In still another aspect of the present invention, there is provided a cable connector wherein a portion in communication with terminal receiving portion in terminal assembly is oblique and a protrusion is formed on terminal. With this, the front ends of terminals may not bend after assembled.

To achieve the above and other objects, the present invention provides a cable connector wherein terminal assembly comprises a front terminal assembly and a rear terminal assembly wherein front terminal assembly includes a partition, a lip extended from the central portion of partition, and an upper extension and a lower extension extended from upper and lower portions of the rear of partition. A plurality of terminal grooves are provided on upper and lower surfaces of lip and the opposed surfaces of upper extension and lower extension. A connecting member is formed to connect terminal grooves of lip and extensions. A plurality of terminal channels are provided on upper and lower surfaces of rear terminal assembly for receiving terminals which extend forward to reach terminal grooves of front terminal assembly. Two posts are provided on two front corners of rear terminal assembly to engage with partition of front terminal assembly for securing front terminal assembly and rear terminal assembly together. Further, engagement mechanism is provided in rear terminal assembly for securing upper terminal cover, lower terminal cover, and rear terminal assembly together.

The above and other objects, features and advantages of the present invention will become apparent from the following detailed description taken with the accompanying drawings.

DETAILED DESCRIPTION OF THE PREFERRED EMBODIMENTS

Figure 1:
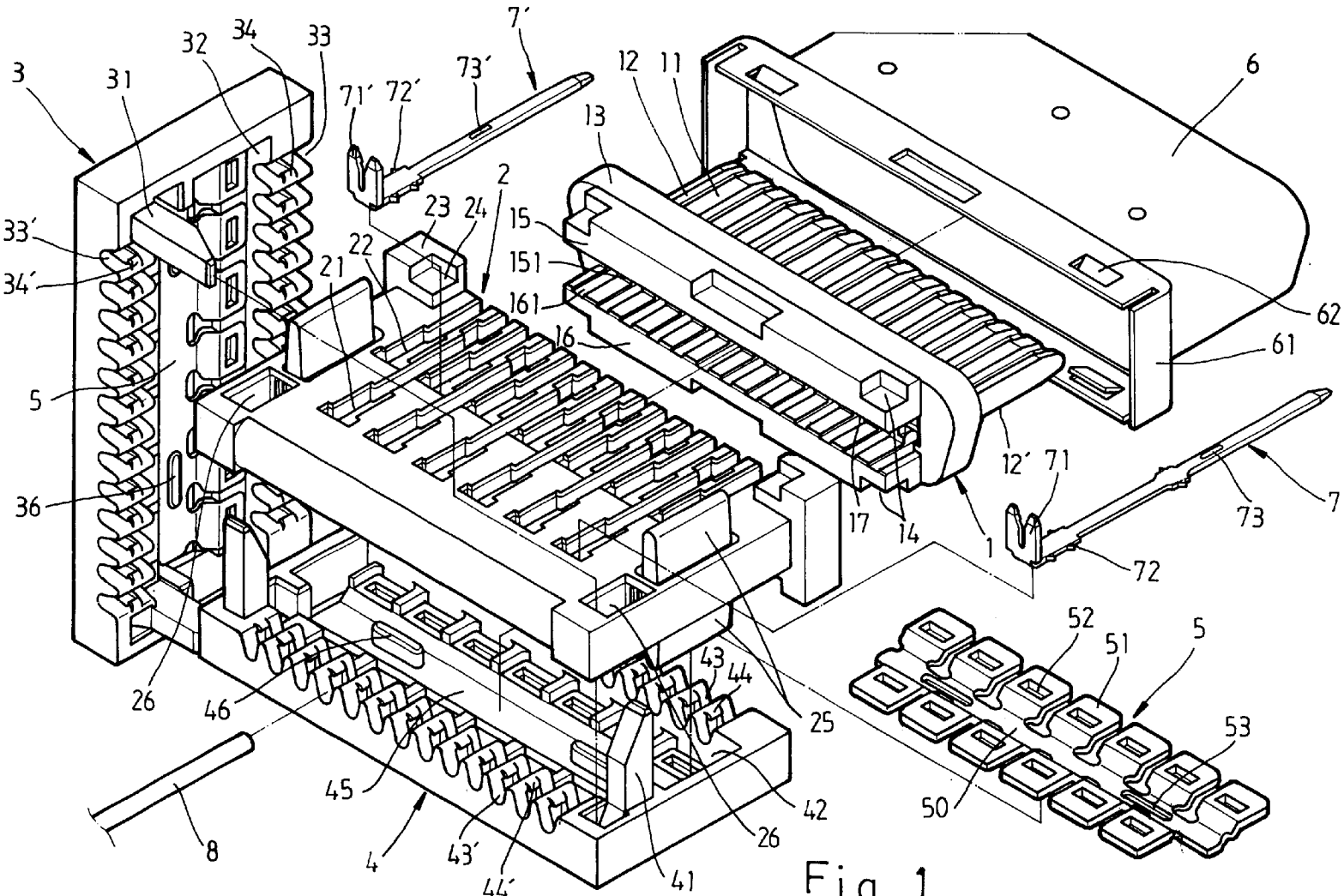
FIG. 1 is an exploded view of a preferred embodiment of cable connector according to the invention.
Figure 4:
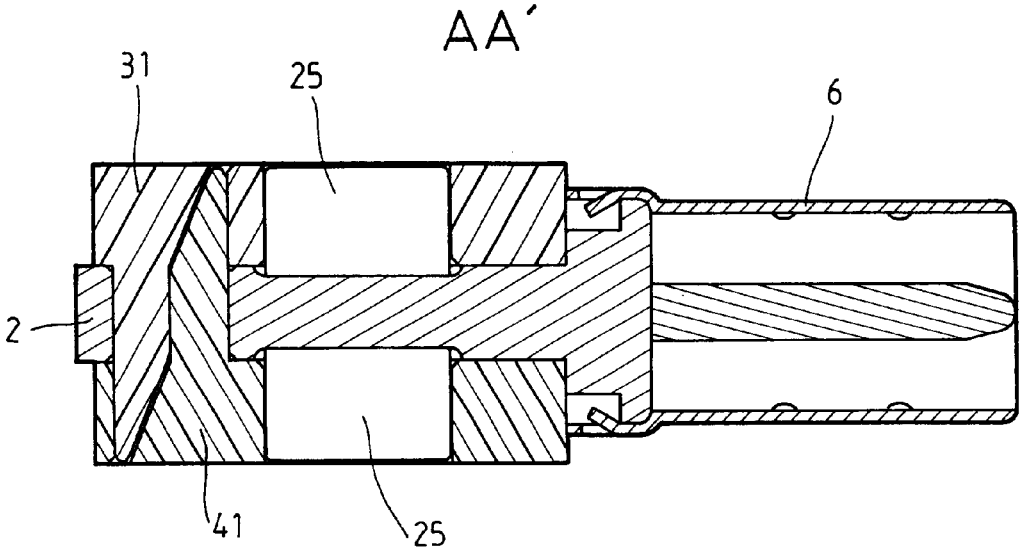
FIG. 4 is a sectional view taken along line A—A' shown in FIG. 3.
Figure 5:
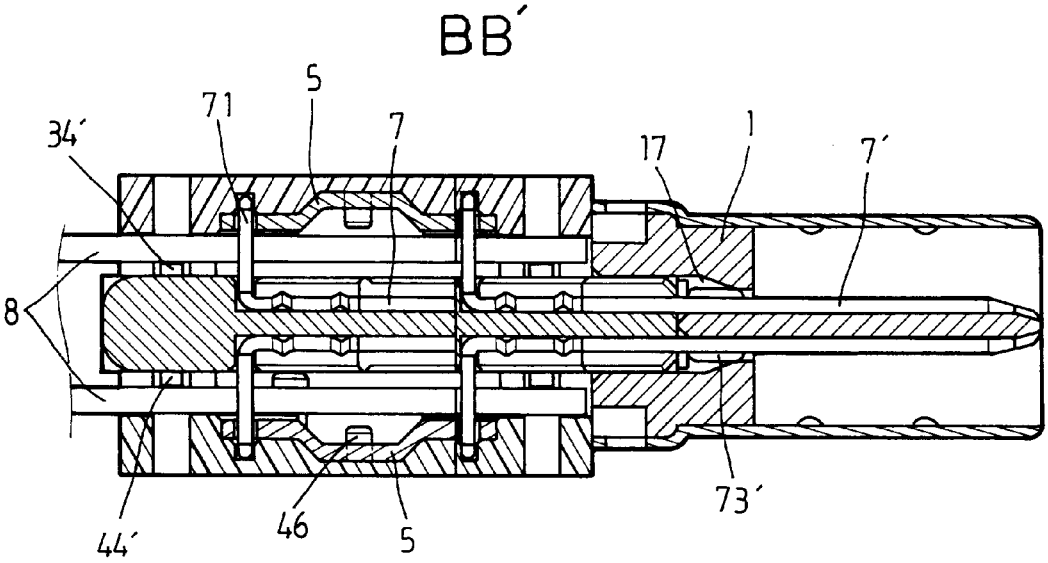
FIG. 5 is a sectional view taken along line B—B' shown in FIG. 3.

Referring to FIGS. 1, 4, and 5, there is shown a cable connector constructed in accordance with the invention comprising a front terminal assembly 1, a rear terminal assembly 2, an upper terminal cover 3, a lower terminal cover 4, a conductive member 5, a metal frame 6, and a plurality of insulation displacement terminal 7 and 7' wherein front terminal assembly 1 and rear terminal assembly 2 are snapped together, terminals 7 and 7' are received in rear terminal assembly 2 being extended to front terminal assembly 1, upper terminal cover 3 and lower terminal cover 4 are secured to upper and lower surfaces of rear terminal assembly 2 by an engagement mechanism (as detailed later), resulting in securing conductive member 5, terminals 7 and 7', and cable 8 connected to terminals 7 and 7' in rear terminal assembly 2, and front terminal assembly 1 is enclosed by metal frame 6 for preventing cable connector from being interfered by electromagnetic interference when cable connector is connected to a mating connector (not shown).

Front terminal assembly 1 includes a partition 13, a lip 11 extended from the central portion of partition 13, and an upper extension 15 and a lower extension 16 extended from upper and lower portions of the rear of partition 13 respectively. A plurality of terminal grooves 12 and 12' are provided on upper and lower surfaces of lip 11. A plurality of terminal grooves 151 are provided on the lower surface of upper extension 15 in communication with terminal grooves 12 of lip 11. Also, a plurality of terminal grooves 161 are provided on the upper surface of lower extension 16 in communication with terminal grooves 12' of lip 11. A connecting member 17 is abutted on partition 13. An oblique portion is formed between connecting member 17 and partition 13. Protrusions 73 and 73' are provided in terminals 7 and 7' such that the front ends of terminals 7 and 7' may not bend after assembled (see FIG. 4).

A plurality of terminal channels 21 and 22 are provided on upper and lower surfaces of rear terminal assembly 2 for receiving long terminals 7 and short terminals 7'. The terminals 7 and 7' further extend forward to reach terminal grooves 12 and 12' of front terminal assembly 1. Terminals on the upper surface of rear terminal assembly 2 extend to terminal grooves 12 of upper surface of lip 11 along terminal grooves 151, while terminals on the lower surface of rear terminal assembly 2 extend to terminal grooves 12' of lower surface of lip 11 along terminal grooves 161. Two posts 23 provided on two front corners of rear terminal assembly 2 engage with the rear of partition 13 when assembled with front terminal assembly 1. In front terminal assembly 1, two recesses 14 are provided on two ends of upper extension 15, while two recesses 14 are provided on two ends of lower extension 16. Correspondingly, in rear terminal assembly 2 two recesses 14 are provided on two ends of both posts 23. Two latches 62 are provided on upper and lower sides of rear engaging member 61 of metal frame 6. Latches 62 can secure to recesses 14.

Upper terminal cover 3 and lower terminal cover 4 are matingly secured to enclose the upper and lower sides of rear terminal assembly 2. A plurality of positioning grooves 33 and 33' are provided on upper terminal cover 3 corresponding to terminal grooves 21 and 22 respectively. Also, a plurality of positioning grooves 43 and 43' are provided on lower terminal cover 4 corresponding to terminal grooves 21 and 22 respectively. Positioning grooves 33 and 43 may position terminals 7 and 7', while positioning grooves 33' and 43' may position cable 8 connected to terminals 7 and 7'. A conductive seat 35 is provided between positioning grooves 33 and 33' on upper terminal cover 3, while a conductive seat 45 is provided between positioning grooves 43 and 43' on lower terminal cover 4. Two spaced projections 36 are provided on conductive seat 35, while two spaced projections 46 are provided on conductive seat 45. Conductive member 5 is secured to conductive seats 35 and 45 by means of projections 36 and 46. A tab 34, 34', 44, or 44' is formed in positioning groove 33, 33', 43, or 43'. These tabs 34, 34', 44, and 44' can secure terminals 7 and 7' and cable 8 together.

Engagement mechanism is configured by positioning pegs 25, 31, and 41 and corresponding positioning openings 26, 32, and 42 both disposed in rear terminal assembly 2 and terminal covers 3 and 4. Positioning peg 25 of rear terminal assembly 2 is extended in both upward and downward directions to engage with positioning opening 32 of upper terminal cover 3 and positioning opening 42 of lower terminal cover 4. Positioning pegs 31 of upper terminal cover 3 have wedge shapes, while positioning pegs 41 of lower terminal cover 4 have mating wedge shapes. As such, both positioning pegs 31 and 41 of terminal covers 3 and 4 are engaged with positioning openings 26 of rear terminal assembly 2 (see FIG. 5).

Two conductive members 5 are secured to conductive seat 35 of upper terminal cover 3 and conductive seat 45 of lower terminal cover 4 respectively. Conductive member 5 includes a base 5 and a plurality of unit bodies 51 on two opposite sides of base 5. Each unit body 51 has a hole 52 with a corresponding attachment member 71 (or 71') of terminal 7 (or 7') inserted through. Further, a connection point is connected between two adjacent unit bodies 51. As such, conductive member 5 may be divided into a plurality of units by breaking connection points. Two spaced slots 53 are provided on base 50 being engaged with projections 36 and 46 of terminal covers 3 and 4.

Figure 2:
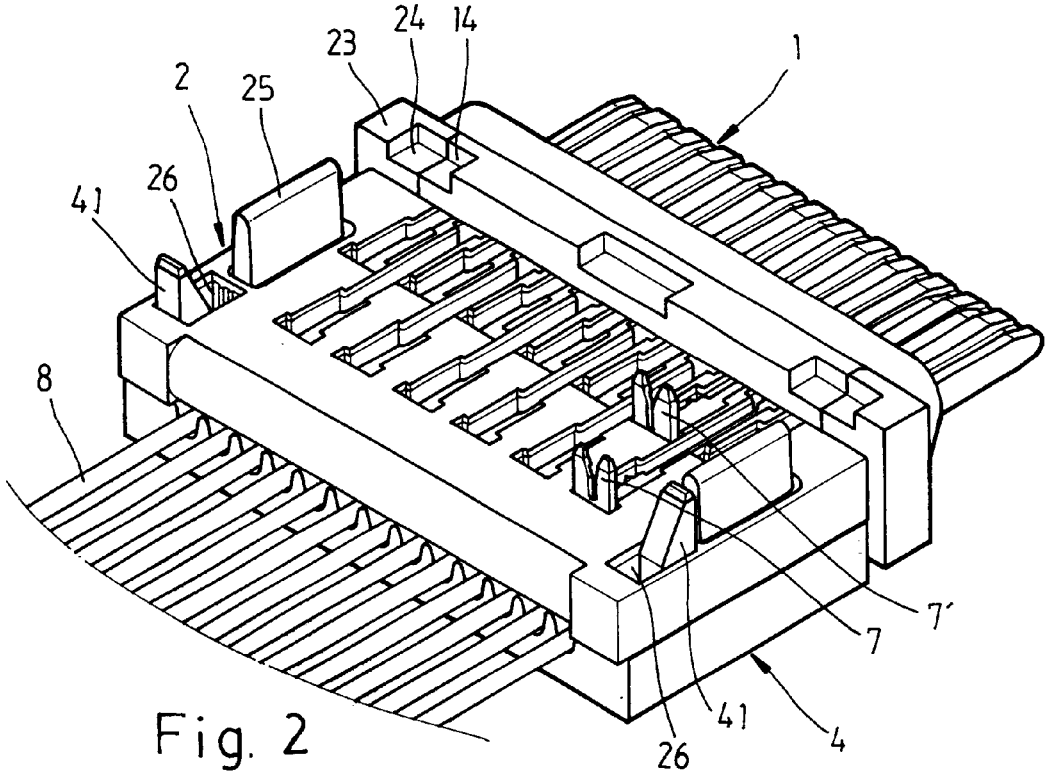
FIG. 2 is a perspective view of the cable connector shown in FIG. 1, the unit being shown during assembling.
Figure 3:
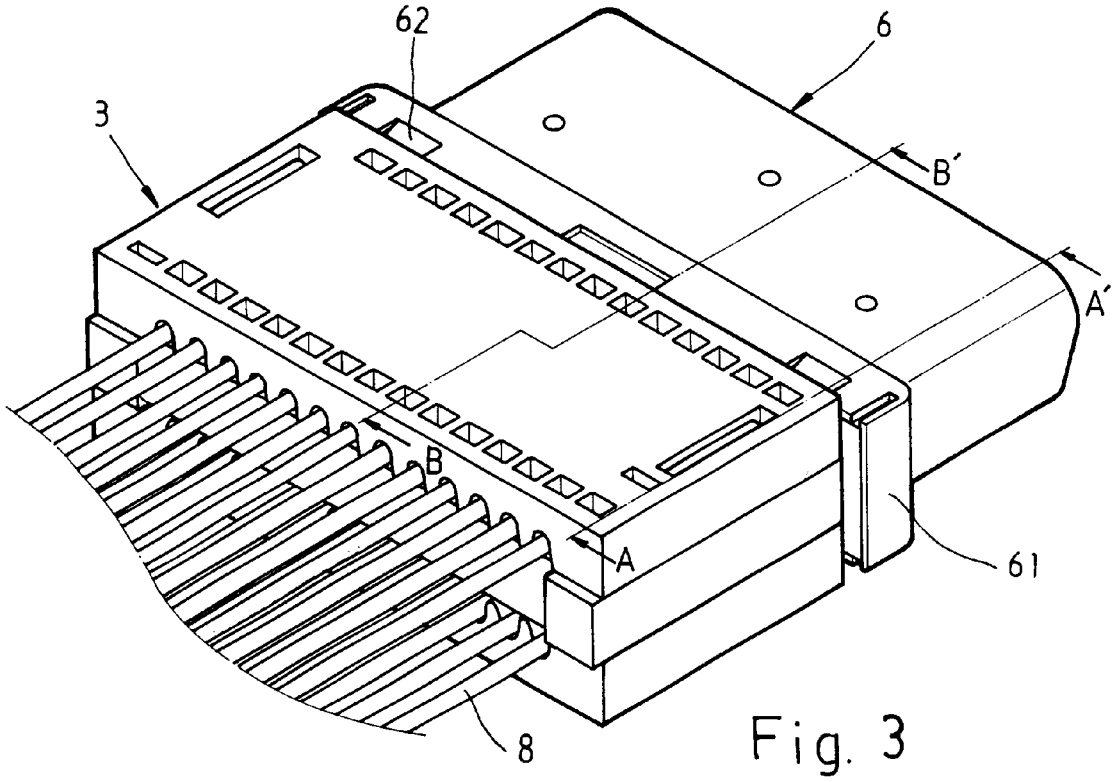
FIG. 3 is a perspective view of the assembled cable connector shown in FIG. 1.

Referring to FIGS. 2 and 3, a description of assembly process of the invention is as below. First, break conductive members 5 into a plurality of units (e.g., two). Then secure conductive members 5 on terminal covers 3 and 4. Secure cable 8 on terminal covers 3 and 4. Engagement mechanism secures upper terminal cover 3, terminal assemblies 1 and 2, and lower terminal cover 4 together. Tabs 72 and 72' of terminals 7 and 7' secure to terminal channels 21 and 22 of rear terminal assembly 2. Attachment member 71 and 71' of terminals 7 and 7' pierce through cable 8 to engage with holes 52 of conductive member 5. This can provide a good electrical contact and enhance the structural strength of connector.

While the invention herein disclosed has been described by means of specific embodiments, numerous modifications and variations could be made thereto by those skilled in the art without departing from the scope and spirit of the invention set forth in the claims.

What is claimed is:

1. A connector attached to a plurality of cables comprising:

a plurality of terminals each including an attachment member pierced through the corresponding cable for electrically contacting with the conductive core of the cable;

a terminal assembly having a plurality of terminal grooves for receiving the terminals;

a terminal cover assembly consisting of an upper terminal cover and a lower terminal cover matingly secured to enclose upper and lower sides of the terminal assembly the terminal cover assembly including a plurality of positioning grooves corresponding to the terminal grooves of the terminal assembly for securing the terminals and cables attached to the terminals;

a pair of conductive seats provided on the upper and lower terminal cover respectively abutted on the positioning grooves;

an engagement means for securing the terminal assembly, the upper terminal cover, and the lower terminal cover together; and a conductive member secured to the conductive seats including a base and a plurality of unit bodies on two opposite sides of the base, each unit body having a hole with the corresponding attachment member of the terminal inserted through.

2. The connector of claim 1, further comprising a plurality of connection points each connected between two adjacent unit bodies of the conductive member.

3. The connector of claim 2, further comprising one or more projections on each conductive seat and one or more holes on the base of the conductive member, thereby securing the conductive member to the conductive seats by engaging the projections with the holes.

4. The connector of claim 1, wherein the engagement means comprises a plurality of positioning pegs and a plurality of positioning openings corresponding to the positioning pegs disposed on the terminal assembly and the upper and lower terminal covers wherein each of the positioning pegs of the terminal assembly is extended in both upward and downward directions to engage with the positioning opening of the upper and lower terminal covers, the positioning pegs of the upper terminal cover have wedge shapes and the positioning pegs of the lower terminal cover have mating wedge shapes, and the positioning pegs of the upper and lower terminal covers are engaged with the positioning openings of the terminal assembly.

5. The connector of claim 4, wherein the terminal assembly comprises a front terminal assembly and a rear terminal assembly, the front terminal assembly includes a partition, a lip extended from the central portion of the partition, and an upper extension and a lower extension extended from the upper and lower portions of the rear of the partition, a plurality of terminal grooves are provided on the upper and lower surfaces of the lip and the opposed surfaces of the upper extension and lower extensions, a connecting member is formed to connect the terminal grooves of the lip and the extensions, a plurality of terminal channels are provided on the upper and lower surfaces of the rear terminal assembly for receiving the terminals which extend forward to reach the terminal grooves of the front terminal assembly, two posts are provided on two front corners of the rear terminal assembly to engage with the partition of the front terminal assembly for securing the front and rear terminal assembly together, and the engagement means is provided in the rear terminal assembly for securing the upper and lower terminal covers to the rear terminal assembly.

6. The connector of claim 5, wherein the front terminal assembly further includes a metal frame.

7. The connector of claim 6, wherein each of the upper and lower extensions of the front terminal assembly further includes two first recesses on two ends, each post of the rear terminal assembly includes two second recesses, and the rear of the metal frame includes two latches on the upper and lower sides for securing to the first and second recesses.

8. The connector of claim 7, further comprising an oblique portion formed between the connecting member and the partition and the terminal further comprises a protrusion such that the front end of the terminal does not bend after the oblique portion is engaged with the protrusion.

* * * * *